US008931777B2

(12) United States Patent
Okitsu

(10) Patent No.: US 8,931,777 B2
(45) Date of Patent: Jan. 13, 2015

(54) MULTI-FEED DETECTION APPARATUS, SHEET CONVEYANCE APPARATUS, AND SHEET PROCESSING APPARATUS

(71) Applicant: Canon Denshi Kabushiki Kaisha, Chichibu (JP)

(72) Inventor: Katsuhiko Okitsu, Tokyo (JP)

(73) Assignee: Canon Denshi Kabushiki Kaisha, Chichibu-shi (JP)

( * ) Notice: Subject to any disclaimer, the term of this patent is extended or adjusted under 35 U.S.C. 154(b) by 0 days.

(21) Appl. No.: 14/096,367

(22) Filed: Dec. 4, 2013

(65) Prior Publication Data

US 2014/0091516 A1 Apr. 3, 2014

Related U.S. Application Data

(63) Continuation of application No. PCT/JP2012/004050, filed on Jun. 22, 2012.

(30) Foreign Application Priority Data

Jun. 29, 2011 (JP) ..... 2011-143761

(51) Int. Cl.
*B65H 7/12* (2006.01)

(52) U.S. Cl.
CPC ..... *B65H 7/125* (2013.01); *B65H 2553/82* (2013.01); *B65H 2553/30* (2013.01)
USPC ..... 271/262; 271/265.04

(58) Field of Classification Search
USPC ..... 271/262, 263, 265.04
See application file for complete search history.

(56) References Cited

U.S. PATENT DOCUMENTS

| | | | | |
|---|---|---|---|---|
| 6,168,146 | B1 | 1/2001 | Komuro et al. | |
| 6,234,470 | B1 | 5/2001 | Okitsu et al. | |
| 6,315,284 | B1 | 11/2001 | Komuro et al. | |
| 7,025,348 | B2 * | 4/2006 | Phinney et al. | 271/262 |
| 7,130,245 | B2 * | 10/2006 | Okitsu et al. | 367/125 |
| 7,796,310 | B2 | 9/2010 | Hasegawa et al. | |
| 2007/0235922 | A1 | 10/2007 | Tonami | |
| 2008/0203654 | A1 * | 8/2008 | Chujo et al. | 271/262 |
| 2012/0061901 | A1 * | 3/2012 | Yamamoto et al. | 271/3.16 |

FOREIGN PATENT DOCUMENTS

| | | | |
|---|---|---|---|
| JP | 2005-162424 | A | 6/2005 |
| JP | 2007-276965 | A | 10/2007 |
| JP | 2008-207885 | A | 9/2008 |
| JP | 2010-173742 | A | 8/2010 |

* cited by examiner

*Primary Examiner* — Michael McCullough
(74) *Attorney, Agent, or Firm* — Fitzpatrick, Cella, Harper & Scinto

(57) ABSTRACT

A multi-feed detection apparatus may include an ultrasonic transmission unit, arranged on one side of a conveyance path configured to convey a sheet-like member, for transmitting an ultrasonic wave toward the conveyance path, an ultrasonic reception unit, arranged on the other side of the conveyance path, for receiving the ultrasonic wave from the ultrasonic transmission unit, and a multi-feed determination unit for determining, based on the reception result of the ultrasonic wave received by the ultrasonic reception unit, whether multi-feed of sheet-like members has occurred. The ultrasonic transmission surface of the ultrasonic transmission unit is inclined with respect to the conveyance path, and the ultrasonic reception surface of the ultrasonic reception unit is arranged to be almost parallel to the conveyance path.

18 Claims, 7 Drawing Sheets

MULTI-FEED DETECTION APPARATUS, SHEET CONVEYANCE APPARATUS, AND SHEET PROCESSING APPARATUS

This application is a continuation of International Patent Application No. PCT/JP2012/004050 filed on Jun. 22, 2012, and claims priority to Japanese Patent Application No. 2011-143761 filed on Jun. 29, 2011, the entire content of both of which is incorporated herein by reference.

BACKGROUND OF THE INVENTION

1. Field of the Invention

The present invention relates to a multi-feed detection apparatus which is mounted in an image processing apparatus such as a copying machine, scanner, facsimile machine, or printer, and detects whether multi-feed of a plurality of sheets has occurred, a sheet conveyance apparatus including the multi-feed detection apparatus, and a sheet processing apparatus such as an image reading apparatus or image forming apparatus.

2. Description of the Related Art

A scanner, printer, copying machine, printing machine, ATM (Automated Teller Machine), and the like have a mechanism of separating and conveying sheet-like members one by one. However, multi-feed may occur, in which when only one sheet-like member should be conveyed, two or more sheet-like members are conveyed while overlapping each other partially or entirely. To prevent this, an apparatus which conveys a sheet-like member requires a function of detecting multi-feed of sheet-like members. As the mechanism of detecting multi-feed of sheet-like members, a multi-feed detection apparatus using an ultrasonic wave has prevailed.

In the multi-feed detection apparatus, it is known that when a sheet-like member is irradiated with an ultrasonic wave, the ultrasonic wave is partially reflected by the sheet surface and the reflected wave is diffusely reflected between the sheet surface and an ultrasonic transmitter. An ultrasonic receiver sometimes receives the diffusely reflected wave as a noise component, and the noise component generated by diffuse reflection degrades the sensor performance. To solve this, an arrangement of emitting an ultrasonic wave obliquely to the sheet surface is employed (see Japanese Patent Laid-Open No. 2007-276965).

SUMMARY OF THE INVENTION

To emit an ultrasonic wave obliquely to the sheet surface, as in the Japanese Patent Laid-Open No. 2007-276965, the ultrasonic transmitter and ultrasonic receiver need to be arranged obliquely. However, since the sheet conveyance apparatus and the like are becoming compact more and more, it is becoming difficult to obliquely introduce the ultrasonic transmitter and ultrasonic receiver to face each other in the compact sheet member conveyance apparatus.

The present invention has been made in consideration of the above situation, and provides a multi-feed detection apparatus advantageous for downsizing of the apparatus without degrading the multi-feed detection performance, a sheet conveyance apparatus, and a sheet processing apparatus.

According to the present invention, a multi-feed detection apparatus is comprising an ultrasonic transmission unit, arranged on one side of a conveyance path configured to convey a sheet-like member, for transmitting an ultrasonic wave toward the conveyance path, an ultrasonic reception unit, arranged on the other side of the conveyance path, for receiving the ultrasonic wave from the ultrasonic transmission unit, and a multi-feed determination unit for determining, based on a reception result of the ultrasonic wave received by the ultrasonic reception unit, whether multi-feed of sheet-like members has occurred, wherein an ultrasonic transmission surface of the ultrasonic transmission unit is inclined with respect to the conveyance path, and an ultrasonic reception surface of the ultrasonic reception unit is arranged to be substantially parallel to the conveyance path.

According to the present invention, a multi-feed detection apparatus is comprising an ultrasonic transmission unit, arranged on one side of a conveyance path configured to convey a sheet-like member, for transmitting an ultrasonic wave toward the conveyance path, an ultrasonic reception unit, arranged on the other side of the conveyance path, for receiving the ultrasonic wave from the ultrasonic transmission unit, and a multi-feed determination unit for determining, based on a reception result of the ultrasonic wave received by the ultrasonic reception unit, whether multi-feed of sheet-like members has occurred, wherein the ultrasonic transmission unit and the ultrasonic reception unit have different inclination angles with respect to the conveyance path.

Further, the present invention may be applied to a sheet conveyance apparatus in which the above-described multi-feed detection apparatus is arranged as a multi-feed detection unit in a conveyance apparatus main body configured to convey a sheet-like member along a conveyance path. Also, the present invention may be applied to a sheet processing apparatus such as an image reading apparatus including the sheet conveyance apparatus and an image reading unit for reading an image of a sheet-like member conveyed by the sheet conveyance apparatus, or an image forming apparatus including the sheet conveyance apparatus and an image forming unit for forming an image on a sheet-like member conveyed by the sheet conveyance apparatus.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Preferred embodiments of the present invention will now be described below in detail with reference to the drawings. It should be noted that the dimensions, materials, shapes, relative arrangement, and the like of components set forth in these embodiments do not limit the scope of the present invention unless it is specifically stated otherwise.

Figure 1:
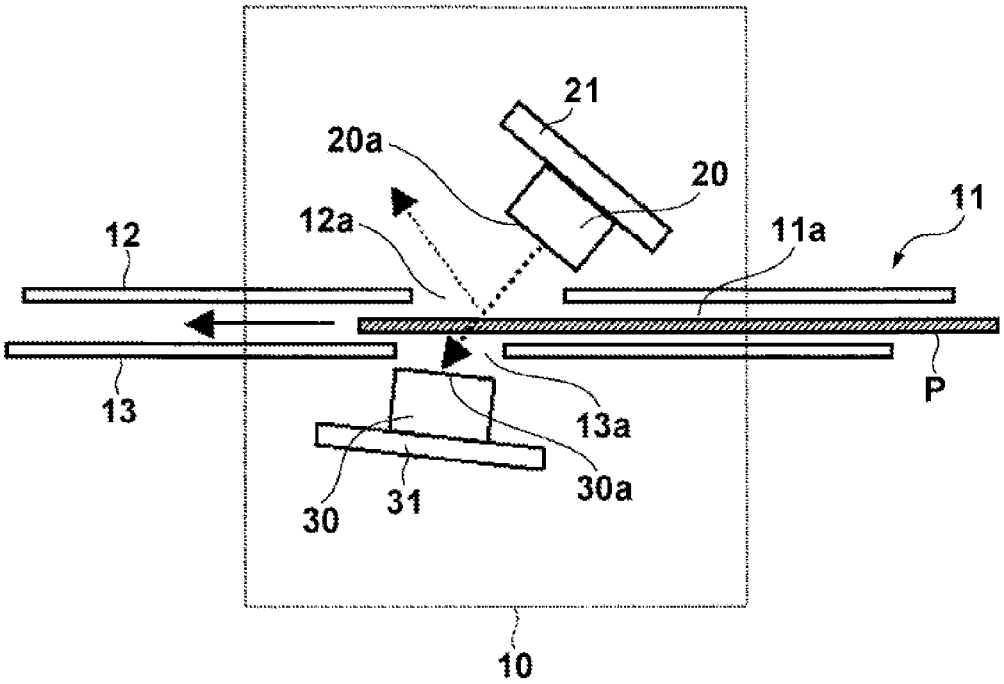
FIG. 1 is a view showing the schematic structure of a multi-feed detection apparatus when viewed from the side.
Figure 2:
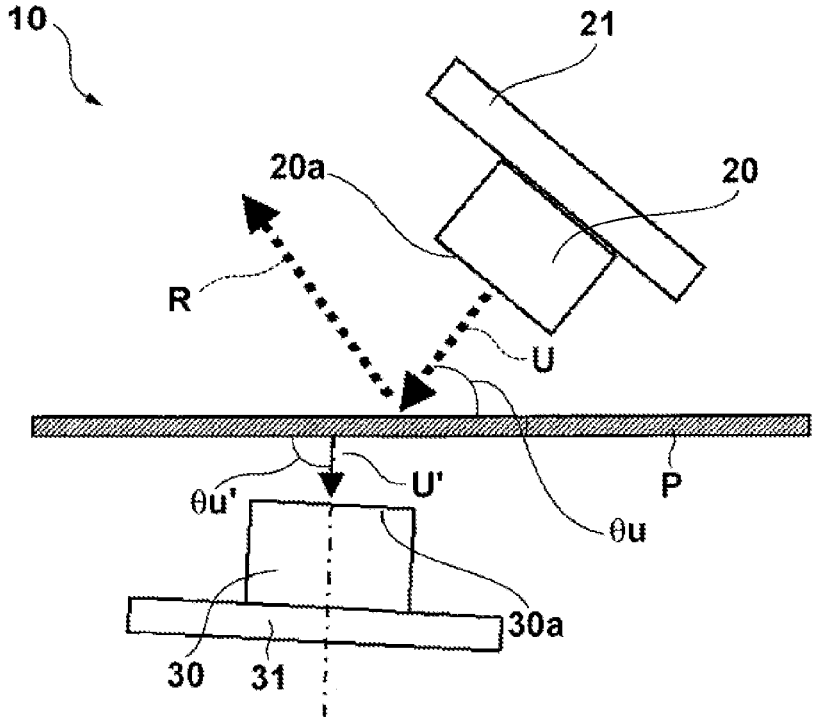
FIG. 2 is a schematic view showing the arrangement of the main part of the multi-feed detection apparatus.

FIG. 1 is a view showing the schematic structure of a multi-feed detection apparatus according to the first embodiment of the present invention when viewed from the side. FIG. 2 is a schematic view showing the arrangement of the main part of the multi-feed detection apparatus according to the first embodiment of the present invention.

As shown in FIGS. 1 and 2, a multi-feed detection apparatus 10 according to the embodiment is an apparatus which is arranged on a conveyance path configured to convey a sheet-like member (to be simply referred to as a sheet member hereinafter) and detects, by an ultrasonic method, multi-feed in which a plurality of sheet members are conveyed while overlapping each other.

More specifically, as shown in FIG. 1, a conveyance path 11 for conveying a sheet member P while keeping it flat in the horizontal direction is inserted in the sheet conveyance path. The conveyance path 11 is covered with two conveyance guide plates 12 and 13, that is, the upper conveyance guide plate (conveyance path forming member) 12 on the upper surface side and the lower conveyance guide plate (conveyance path forming member) 13 on the lower surface side which face each other via a flat conveyance space 11*a*. In the multi-feed detection apparatus 10 having this arrangement, an ultrasonic transmitter 20 is disposed as an ultrasonic transmission (origination) unit above the conveyance path 11, and an ultrasonic receiver 30 is disposed as an ultrasonic reception unit below it so that they face each other via the conveyance path 11.

When detecting multi-feed of sheet members by using an ultrasonic sensor made up of the transmitter 20 and receiver 30, the following detection performance unique to the ultrasonic wave is obtained:

(1) This arrangement detects multi-feed in a non-contact state without contacting a sheet member, and does not hinder conveyance of a sheet member.

(2) This arrangement can detect multi-feed regardless of the thickness of a sheet member, and can detect even multi-feed in which sheet members of different thicknesses coexist.

(3) This arrangement can detect multi-feed without the influence of the color of a sheet member, and does not require adjustment even if the color of a sheet member changes.

By using the ultrasonic sensor, multi-feed of sheet members can be detected at high sensitivity. However, in some cases, when a sheet member is irradiated with an ultrasonic wave, the ultrasonic wave is partially reflected by the sheet surface and the reflected wave is diffusely reflected between the sheet surface and the transmitter. Depending on the arrangement of the ultrasonic transmitter and receiver, the receiver sometimes receives the diffusely reflected wave as a noise component, and the noise component generated by diffuse reflection degrades the sensor performance. To solve this, it is necessary to incline (give an angle) the ultrasonic wave traveling direction with respect to the sheet member (conveyance path) so that the reflected wave is reflected in a direction different from the direction toward the transmitter. In a high-directivity ultrasonic sensor, the transmission surface of the transmitter and the reception surface of the receiver need to be arranged parallel to face straight each other. Under the circumstances, it is very difficult to downsize the apparatus. To solve this, the multi-feed detection apparatus 10 according to the embodiment devises the arrangement and configuration of the ultrasonic receiver 30 with respect to the conveyance path 11, and the like, details of which will be described later.

More specifically, the ultrasonic transmitter 20 is attached to a substrate 21 having a fixing member to a main body apparatus (not shown), and a circuit board including a driving circuit and the like. The receiver 30 is also attached to a substrate 31 having a fixing member to the main body apparatus (not shown), and a circuit board including an amplifier circuit and the like.

An entrance port (through hole) 12*a* is formed at the crossing position of the upper conveyance guide plate 12 where the upper conveyance guide plate 12 crosses the ultrasonic transmission direction of the transmitter 20. An ultrasonic transmission surface 20*a* of the transmitter 20 emits an ultrasonic wave U in an obliquely downward transmission direction. The emitted ultrasonic wave U enters the conveyance space 11*a* in the conveyance path 11 via the entrance port 12*a* formed in the upper conveyance guide plate 12, and irradiates the sheet member P passing through the conveyance space 11*a*.

The transmitter 20 takes an arrangement form in which the transmission direction is suited to transmit the ultrasonic wave U, as represented by an incline θu with respect to the sheet member P. By setting the transmission direction of the transmitter 20 obliquely to the sheet member P, the ultrasonic wave U transmitted by the transmitter 20 is reflected by the surface of the sheet member P, and a reflected wave R travels in a direction different from the direction toward the transmitter 20 and does not return to the transmitter 20. Accordingly, generation of a noise component such as an interference acoustic wave or reverberant acoustic wave can be reduced between, for example, the transmitter 20 and the sheet member P.

An exit port 13*a* is formed at the crossing position of the lower conveyance guide plate 13 where the lower conveyance guide plate 13 crosses the ultrasonic reception direction of the receiver 30. Note that the area of the exit port 13*a* formed at the crossing position of the lower conveyance guide plate 13 is suitably set to be almost equal to or smaller than the area of an ultrasonic reception surface 30*a* of the receiver 30 and be larger than half the area of the reception surface 30*a* in order to prevent entrance of dust and the like, as long as the reception performance can be maintained. Hence, mixing of paper dust and the like from the exit port 13*a* can be suppressed to reduce the influence on reception of an ultrasonic wave.

The receiver 30 is arranged to be almost parallel (including parallel) to the conveyance path 11 (sheet member P). In the embodiment, an angle θu' is set to be θu'≈90°. This is because the sound pressure of an ultrasonic wave U' having passed through the sheet member P becomes sufficiently low and a large interference hardly occurs between the receiver 30 and the sheet member P. The arrangement in which the receiver 30 is arranged to be almost parallel to the conveyance path 11 includes, for example, a state in which the reception surface 30*a* becomes a surface parallel to or slightly inclined with respect to the conveyance path 11 while facing the conveyance path 11. This arrangement also includes a state in which the reception surface 30*a* of the receiver 30 substantially faces the transmission surface 20*a* of the transmitter 20 when viewed from the transmission surface 20*a* of the transmitter 20. The directivity of the ultrasonic wave U' slightly decreases when the ultrasonic wave U' passes through the sheet member P. Considering this, the angle of the receiver 30 may be changed to be almost parallel to the sheet member P. That is, the transmitter 20 and receiver 30 are arranged to satisfy a relation of θu<θu'≈90°. In addition, the receiver 30 is preferably a MEMS (Micro Electro Mechanical System) ultra-compact ultrasonic receiver with low directivity. Even when such an ultra-compact ultrasonic receiver is used and combined with a high-directivity ultrasonic transmitter, the receiver 30 (reception surface 30*a*) can reliably receive an ultrasonic wave from the transmitter 20 even if the receiver 30 is downsized, because the transmission surface 20*a* of the transmitter 20 substantially faces the reception surface 30*a* of the receiver 30.

The MEMS element structure is not particularly limited, but preferably includes a MEMS element which includes an ultrasonic receiver of a plate shape or the like with an ultrasonic reception surface and a holding portion for holding the ultrasonic receiver, and is formed on a substrate such as a silicon substrate. By using a microfabrication technique for a substrate of a silicon material or the like, a desired structure can be relatively easily fabricated, implementing an ultra-compact receiver.

If such a MEMS sensor chip is applied to the receiver 30, the reception surface and mounting substrate can be substantially downsized, compared to a conventional ultrasonic receiver. For this reason, the amount of ultrasonic wave reflected by the ultrasonic reception surface and mounting substrate surface becomes smaller than that in the conventional ultrasonic receiver. Since a reflected wave generated between the sheet member P and the receiver 30 is reduced, preferable detection performance can be obtained even if the sheet member P and reception surface 30*a* are arranged to be almost parallel. Note that the MEMS receiver preferably has a smooth frequency characteristic and a sensitivity in a wide frequency range. Therefore, it is preferable to use the MEMS sensor for the receiver because a change of the ultrasonic frequency to be received can be satisfactorily coped with by changing a filtering circuit & amplifier circuit and determination circuit at a subsequent stage.

As described above, the receiver 30 is arranged on the substrate 31 having a fixing member to the main body apparatus (not shown), and a circuit board including an amplifier circuit and the like. Since the receiver 30 can be arranged to be almost parallel to the conveyance path 11, various merits are obtained: the receiver 30 need not be arranged on the substrate 31 with a large inclination, the receiver 30 can be easily mounted on the substrate 31, and the mounting space can be reduced.

In the multi-feed detection apparatus 10 according to the embodiment, the inclination angles of the transmitter 20 and receiver 30 with respect to the conveyance path 11 are different. More specifically, the ultrasonic transmission surface 20*a* of the transmitter 20 is arranged to be inclined with respect to the conveyance path 11. The ultrasonic reception surface 30*a* of the receiver 30 is arranged to be almost parallel to the conveyance path 11. Thus, the multi-feed detection performance does not degrade, and the apparatus can be greatly downsized thanks to reduction of the installation space of the receiver 30. When examining a structure in which the receiver 30 is mounted in the apparatus main body, the degree of freedom of the design can be increased, and the product or manufacturing cost can be greatly reduced.

In the above-described embodiment, the outer shape of the receiver 30 serving as an ultrasonic reception unit is preferably set to be smaller than that of the transmitter 20 serving as an ultrasonic transmission unit. For example, the ultrasonic reception surface 30*a* (area of the reception region) of the receiver 30 is desirably set to be smaller than the ultrasonic transmission surface 20*a* (area of the transmission region) of the transmitter 20. The use of the MEMS microelement as the receiver 30 is not only advantageous for downsizing of the apparatus, but also widens the directivity on the receiving side (increases the ultrasonic reception sensitivity). By combining the MEMS microelement with the high-directivity transmitter 20, desired multi-feed detection performance can be ensured. In this arrangement, the ultrasonic reception surface 30*a* of the receiver 30 is positioned in a region where it faces the ultrasonic transmission surface 20*a* of the transmitter 20. The implementation of this positional relationship is advantageous for downsizing of the apparatus, and facilitates positioning (attachment) of the receiver 30 with respect to the transmitter 20. This can increase the degree of freedom of the design, improve the assembly accuracy, and reduce the manufacturing cost.

Further, in the present invention, the opening area of the entrance port of the upper conveyance guide plate is preferably set to be smaller than the ultrasonic transmission surface of the transmitter. That is, a condition that the size (opening area) of the entrance port through which an ultrasonic wave enters the conveyance path from the ultrasonic transmission surface is smaller than the area of the ultrasonic transmission surface (for example, a condition to satisfy a relation of [size of the ultrasonic transmission surface]>[size of the originating-side conveyance path hole (opening)]≥[size of the receiving-side conveyance path hole (opening)]≥[size of the ultrasonic reception surface]) is preferably set. This can effectively prevent degradation of the multi-feed detection performance by the reflected wave of an ultrasonic wave in the conveyance path.

Figure 3:
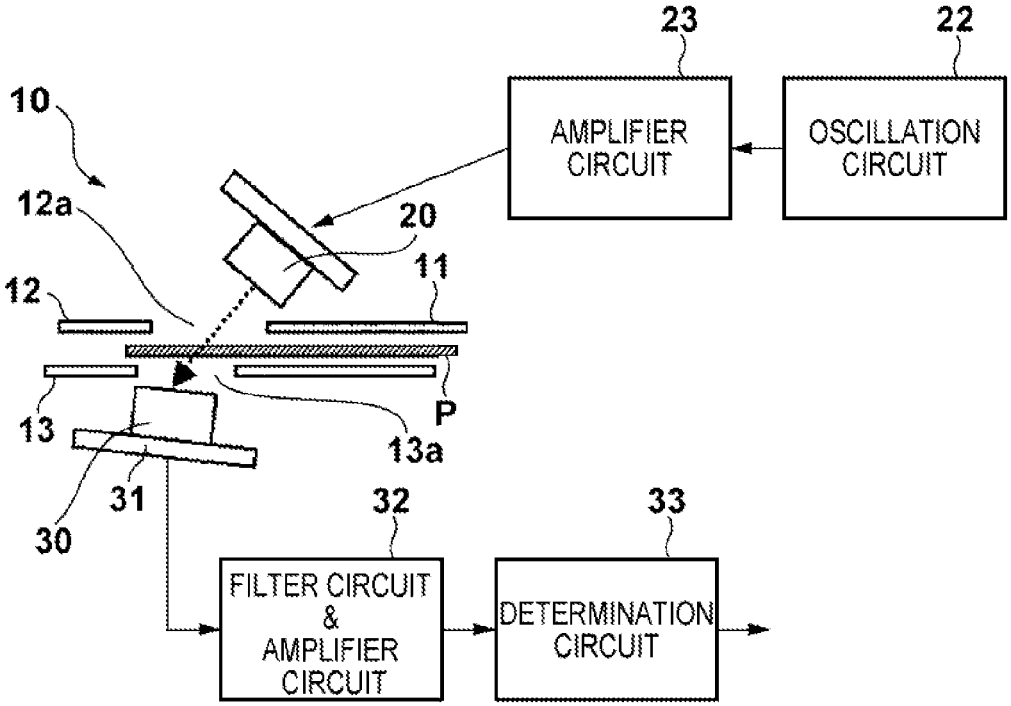
FIG. 3 is a block diagram showing the arrangement of signal processing in the multi-feed detection apparatus.

The control arrangement of the above-described multi-feed detection apparatus 10 will be explained in detail with reference to FIG. 3. FIG. 3 is a block diagram showing a control circuit assembled in the multi-feed detection apparatus. The multi-feed detection apparatus 10 according to the embodiment includes, on the ultrasonic transmitting side, an oscillation circuit 22 serving as a signal generation unit for generating a signal of a predetermined frequency (for example, 300 kHz), and an amplifier circuit 23 serving as a signal amplification unit for amplifying a signal from the oscillation circuit 22. The multi-feed detection apparatus 10 includes, on the ultrasonic receiving side, a filter & amplifier circuit 32 which removes noise and amplifies a received signal, and a determination circuit 33 serving as a multi-feed determination unit for comparing a received signal with a reference value to make a determination.

An electrical signal of the predetermined frequency output from the oscillation circuit 22 is amplified by the amplifier circuit 23 to have a predetermined value, then is input to the transmitter 20, and converted into an ultrasonic wave U by an ultrasonic generation element in the transmitter 20. The converted ultrasonic wave U is radiated toward the receiver 30 via the sheet member P conveyed through the conveyance path 11.

The ultrasonic wave U emitted by the transmitter 20 impinges on the sheet member P conveyed in the conveyance path 11, and is partially radiated outside as the reflected wave R. The ultrasonic wave U' having passed through the sheet member P is received by the receiver 30, and converted into an electrical signal by the piezoelectric element or MEMS element of the receiver 30. The signal converted into the electrical signal is processed by the filter circuit & amplifier circuit 32 having the filter function of removing noise and the amplification function. By comparison with a threshold, the determination circuit 33 determines whether one sheet member P has been conveyed or a plurality of sheet members P have been conveyed. Based on the result, the determination circuit 33 detects the presence/absence of multi-feed of the sheet members P. Note that this determination signal is sent to a sheet member conveyance control system (for example, a control unit such as a CPU) (not shown).

Figure 4:
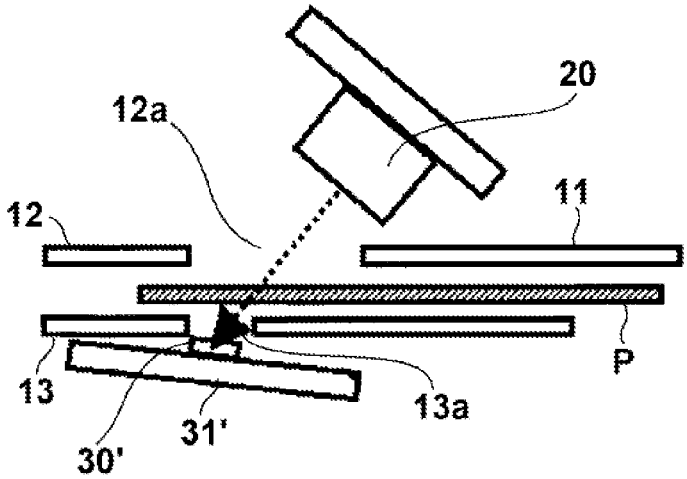
FIG. 4 is a schematic view showing the arrangement of the main part of the multi-feed detection apparatus.

As described above, in the multi-feed detection apparatus 10 according to the embodiment, the ultrasonic receiver 30 is arranged to be almost parallel to the conveyance path 11 through which the sheet member P is conveyed. Compared to a conventional arrangement, the size in the direction of height can be reduced, greatly downsizing the apparatus. Especially when the structure of the ultrasonic receiver is downsized by the MEMS technique, as shown in FIG. 4, a MEMS receiver 30' and substrate 31' can be arranged without taking up space in the vertical direction in FIG. 4 by bringing them close to the conveyance path 11 to be almost parallel. This is further effective in downsizing of the apparatus. FIG. 4 exemplifies a structure in which the outer shape of the receiver 30' serving as an ultrasonic reception unit is set to be smaller than that of the transmitter 20' serving as an ultrasonic transmission unit. In the structure of FIG. 4, the outer shape of the receiver 30' is set to be small, so the opening area of the exit port 13*a* can be decreased. Mixing of paper dust and the like can be effectively suppressed, and the influence on ultrasonic detection can be effectively reduced.

In a piezoelectric vibration ultrasonic sensor, the ultrasonic resonance frequency in the element is fixed, and it is difficult to generate an ultrasonic wave of another frequency. Under the physical condition, the ultrasonic frequency usable in a pair of ultrasonic sensors is one type. In the ultrasonic multi-feed detection method, an ultrasonic wave is applied to a sheet member, and multi-feed is determined from the intensity of the ultrasonic wave having passed through the sheet member. In an ultrasonic multi-feed detection unit having a high oscillation frequency around 300 kHz, when multi-feed of very thin sheet members occurs, the signal appropriately attenuates, and the multi-feed can be normally detected. However, for very thick sheet members, attenuation by the sheet members becomes large, and multi-feed may be erroneously detected. To the contrary, in an ultrasonic multi-feed detection unit having a low oscillation frequency around 200 kHz, attenuation by sheet members becomes small, and multi-feed may be erroneously detected for thin sheet members. If piezoelectric ceramic is used in the ultrasonic oscillation unit and reception unit, the resonance frequency of the ultrasonic oscillator and ultrasonic receiver is fixed to the resonance frequency of the piezoelectric ceramic used and the acoustic matching layer, and cannot be changed. Even if a driving voltage of a frequency deviating from this resonance frequency is applied, no satisfactory oscillation amplitude can be obtained, and separate ultrasonic oscillators having adjusted resonance frequencies need to be prepared in accordance with necessary ultrasonic frequencies.

To avoid this, the present invention implements an arrangement in which a plurality of ultrasonic frequencies are used in accordance with the materials of sheet members. An arrangement in which a plurality of ultrasonic frequencies are used in addition to the arrangement of the first embodiment will be explained in detail by citing an embodiment.

Figure 5:
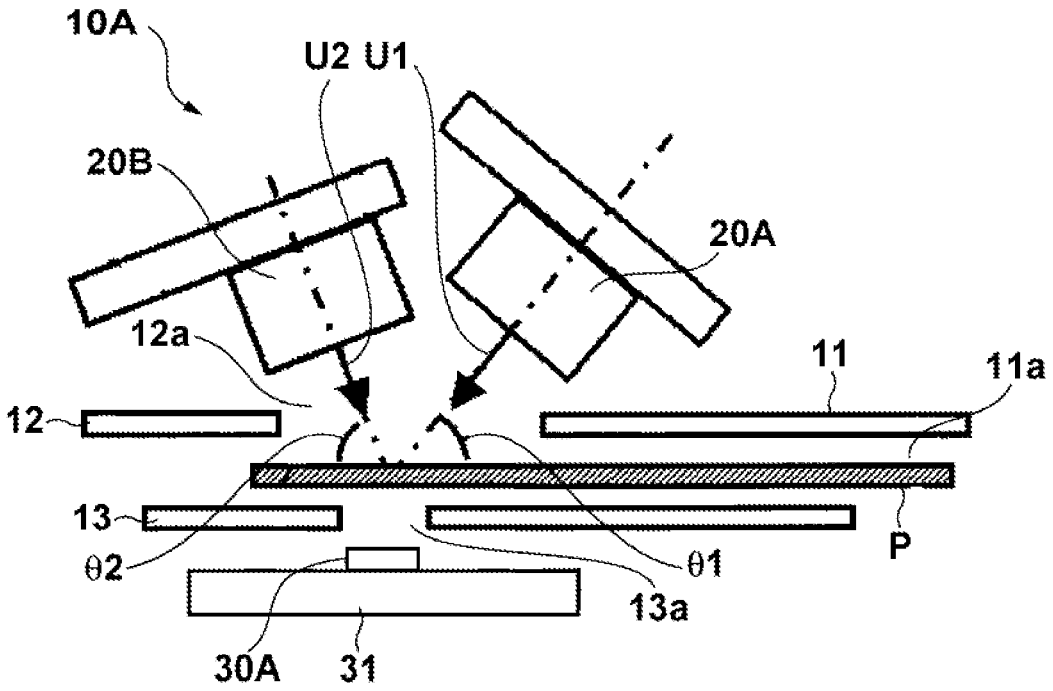
FIG. 5 is a view showing the schematic structure of a multi-feed detection apparatus when viewed from the side.

FIG. 5 is a schematic view showing an arrangement near a sheet member multi-feed detection apparatus incorporated in an image reading apparatus or the like. In FIG. 5, the same reference numerals as those in FIG. 1 denote the same parts, and a repetitive description thereof will be omitted.

As shown in FIG. 5, a multi-feed detection apparatus 10A includes a conveyance path 11 for conveying a sheet member P while keeping it flat in the horizontal direction in FIG. 5. The conveyance path 11 is covered with two conveyance guide plates 12 and 13, that is, the upper conveyance guide plate 12 on the upper surface side and the lower conveyance guide plate 13 on the lower surface side which face each other via a flat conveyance space 11*a*.

In the multi-feed detection apparatus 10A, a plurality of transmitters 20A and 20B are disposed above the conveyance path 11, and a receiver 30A is disposed below it so that they face each other via the conveyance path 11. The transmitter 20A emits an ultrasonic wave U1 to a sheet member, and the transmitter 20B emits an ultrasonic wave U2 to the sheet member P. The transmitters 20A and 20B are configured to transmit ultrasonic waves of different frequencies.

An entrance port 12*a* is formed at the crossing position of the upper conveyance guide plate 12 where the upper conveyance guide plate 12 crosses the ultrasonic wave U1 from the transmitter 20A and the ultrasonic wave U2 from the transmitter 20B. The transmitters 20A and 20B forming an ultrasonic sensor take an arrangement form in which the ultrasonic transmission directions are set obliquely to the sheet member P and suited to transmission of the ultrasonic waves U1 and U2. In particular, f1 is the frequency of the ultrasonic wave U1 of the transmitter 20A, f2 is the frequency of the ultrasonic wave U2 of the transmitter 20B, $\theta 1$ is an internal angle formed by the ultrasonic wave U1 and sheet member P, and $\theta 2$ is an internal angle formed by the ultrasonic wave U2 and sheet member P. Similar to the first embodiment, the ultrasonic transmission directions of the transmitters 20A and 20B are set obliquely to the sheet member P to reduce reflection and the influence on reverberant noise. The ultrasonic waves U1 and U2 emitted by the transmitters 20A and 20B impinge on the sheet member P conveyed in the lower conveyance guide plate 13, and are partially reflected.

Here, $\theta 1<\theta 2$, and $\theta 1\neq\theta 2$. Thus, an ultrasonic wave reflected by the sheet member P has an angle deviated from the perpendicular of the transmission surface of the facing other transmitter. The ultrasonic wave reflected again by the transmission surface of the other transmitter mentioned above is reflected in a direction different from the direction toward the entrance port 12*a* serving as an opening. The ultrasonic wave U1 or U2 is not multiple-reflected and does not serve as a noise factor.

In this manner, according to the embodiment, as for the two transmitters 20A and 20B, the inclination angle of the ultrasonic transmission surface of one transmitter 20A with respect to the conveyance path 11 is set to be larger than that of the ultrasonic transmission surface of the other transmitter 20B. This can effectively prevent multiple reflection of ultrasonic waves transmitted (originated) by the transmitters 20A and 20B, and can prevent generation of noise.

In the embodiment, if $f1<f2$, a relation of $\theta 1<\theta 2$ desirably holds. This is because, as the frequency of an ultrasonic wave increases, the attenuation amount upon passing through a sheet member increases, and at the same time the directivity is enhanced. Therefore, the transmitters are arranged so that the receiver 30A can easily receive an ultrasonic signal of a high frequency which readily attenuates.

More specifically, in the embodiment, the ultrasonic transmission unit includes a plurality of ultrasonic transmission unit (transmitters 20A and 20B) having different ultrasonic transmission frequencies. The ultrasonic transmission surface of the transmitter 20B having a high ultrasonic transmission frequency is arranged at a larger inclination angle (relation of $\theta 1<\theta 2$) with respect to the conveyance path 11 than the ultrasonic transmission surface of the transmitter 20A having a low ultrasonic transmission frequency. Hence, the receiver 30A can easily receive an ultrasonic signal of a high frequency which readily attenuates. This can improve the multi-feed detection performance.

As described above, according to the embodiment, downsizing is achieved by arranging the ultrasonic reception surface of the receiver 30A serving as an ultrasonic reception unit to be almost parallel to the conveyance path 11. A plurality of transmitters 20A and 20B are arranged for one receiver 30A. The inclination angle of the ultrasonic transmission surface of one transmitter 20B with respect to the conveyance path 11 is set to be larger than that of the ultrasonic transmission surface of the other transmitter 20A. The multi-feed detection performance can be improved while achieving downsizing.

Figure 6:
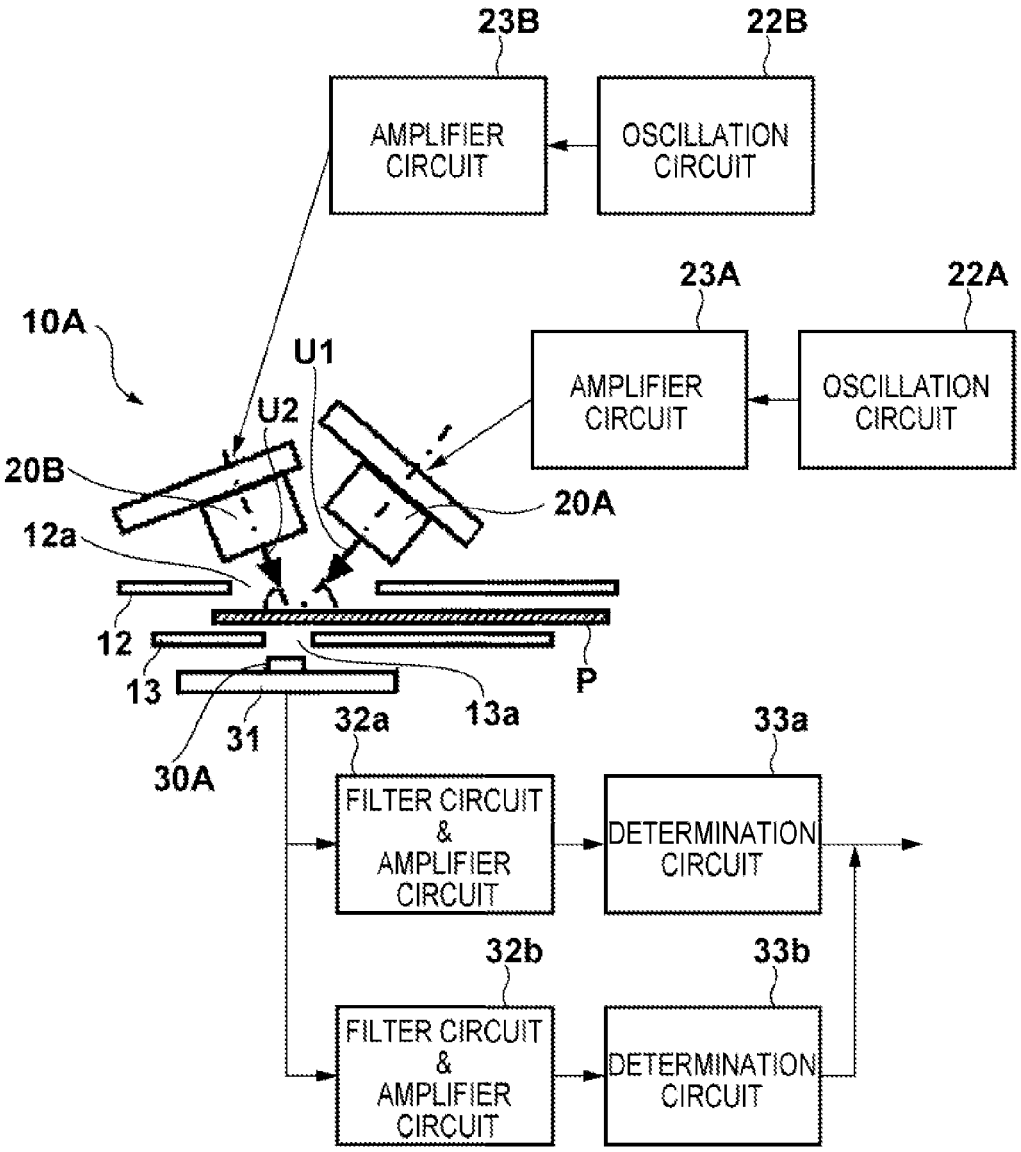
FIG. 6 is a block diagram showing the arrangement of signal processing in the multi-feed detection apparatus.

FIG. 6 is a block diagram showing the control circuit of the ultrasonic sensor assembled in the multi-feed detection apparatus 10A. In this arrangement, the transmitting side includes oscillation circuits 22A and 22B which generate a signal of a predetermined frequency f1 (for example, 200 kHz) and a signal of a predetermined frequency f2 (for example, 300 kHz), and amplifier circuits 23A and 23B which amplify the signals of the predetermined frequencies. The oscillation circuits 22A and 22B and the amplifier circuits 23A and 23B are connected in correspondence with the transmitters 20A and 20B, respectively. The oscillation circuits 22A and 22B may be configured to use variable origination circuits capable of changing the frequency in accordance with an external signal, amplify the variable oscillation signals, and finally select either the transmitter 20A or 20B. This circuit configuration includes a transmitter selection unit.

The receiver 30A converts an ultrasonic wave having passed through the sheet member P into an electrical signal. Filter circuits & amplifier circuits 32*a* and 32*b* having the filter function of removing noise and the amplification function process the signal converted into the electrical signal. The filter circuits & amplifier circuits 32*a* and 32*b* have different frequency filters and different amplification factors. For example, the filter circuit & amplifier circuit 32*a* gives optimal adjustment to the ultrasonic wave U1 transmitted from the transmitter 20A, and the filter circuit & amplifier circuit 32*b* gives optimal adjustment to the ultrasonic wave U2 transmitted from the transmitter 20B. This can be implemented by changing the reception signal amplification condition based on the frequency of an ultrasonic wave transmitted from at least one of the transmitters 20A and 20B serving as a plurality of ultrasonic wave transmission unit.

In addition, the above-described control block arrangement includes determination circuits 33*a* and 33*b* which receive electrical signals from the filter circuits & amplifier circuits 32*a* and 32*b*, compare them with reference values, and make determinations. Also in the determination circuits 33*a* and 33*b*, different determination methods and references are desirably set in accordance with the frequencies of ultrasonic waves. For example, the determination circuit for the high-frequency ultrasonic wave U1 performs voltage comparison with a predetermined threshold. The determination circuit for the low-frequency ultrasonic wave U2 performs phase comparison with a predetermined phase, in addition to voltage comparison with a predetermined threshold. The results of these determinations are integrated and sent to a sheet member conveyance control system (not shown). Note that a filter circuit & amplifier circuit and determination circuit to be used among those of a plurality of systems may be changed in accordance with a transmitter to be used among a plurality of transmitters.

As another example, the filter circuit & amplifier circuit may be formed from one circuit by using a circuit capable of changing the filtering frequency and amplification factor. Further, the determination circuit may be configured digitally or a program on the CPU, and the determination method and determination level may be changed, as needed. As shown in FIG. 6, the plurality of transmitters (oscillators) 20A and 20B may be set on a plane parallel to the sheet member conveyance plane, and the receiver may be arranged at an angle in the ultrasonic origination direction about the axis.

Figure 7:
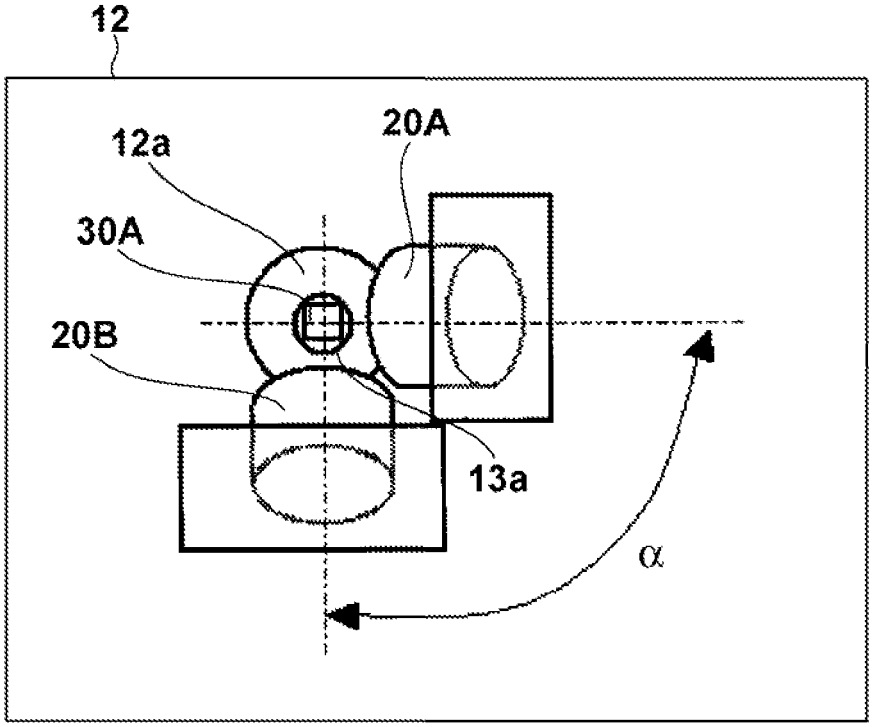
FIG. 7 is a view showing the schematic structure of the multi-feed detection apparatus according to when viewed from the top.

FIG. 7 is a view showing another multi-feed detection apparatus when viewed from a direction perpendicular to the sheet member conveyance plane. The transmitters 20A and 20B are arranged at an inner angle $\alpha$ with respect to the entrance port 12*a* when viewed from above the upper conveyance guide plate 12. When $\alpha \neq 180°$, even if $\theta 1$ and $\theta 2$ mentioned above satisfy $\theta 1 = \theta 2$, no multiple reflection occurs. As for the number of transmitters, two or more transmitters may be arranged as long as they are arranged to prevent multiple reflection. In this manner, a plurality of ultrasonic transmitters having different frequencies are used, and the ultrasonic frequency is changed in accordance with a sheet member to be conveyed, thereby executing more appropriate sheet member multi-feed determination. If the transmitters 20A and 20B serving as ultrasonic transmission unit are arranged at different ultrasonic transmission angles with respect to the receiver 30A when viewed from a direction perpendicular to the ultrasonic reception surface of the receiver 30A serving as one ultrasonic reception unit, more appropriate sheet member multi-feed determination can be implemented. In particular, the transmitters 20A and 20B may be arranged with a positional relationship in which the respective ultrasonic transmission directions to one receiver 30A become perpendicular to each other.

As described above, in the multi-feed detection apparatus 10A according to the embodiment, the directivity of an ultrasonic wave slightly decreases after the ultrasonic wave passes through a sheet-like member, and the directivity is improved by downsizing the receiver (receiving-side element structure) 30A. In consideration of them, the angle of the receiver with respect to the conveyance path 11 is appropriately changed (more specifically, the receiver is arranged to be almost parallel), and the installation size of the multi-feed detection sensor can be reduced. By appropriately changing the angle on the side of the receiver 30A, a plurality of elements can be arranged on the side of the transmitters 20A and 20B, multi-feed detection can be executed at a plurality of ultrasonic frequencies, and multi-feed detection becomes possible for various types of sheet members. More specifically, by executing multi-feed detection at a plurality of ultrasonic frequencies, accurate multi-feed detection can be performed without a malfunction regardless of a change of the thickness of the sheet member, the coating state of the sheet member surface, and a change of the material of the sheet member.

Figure 8:
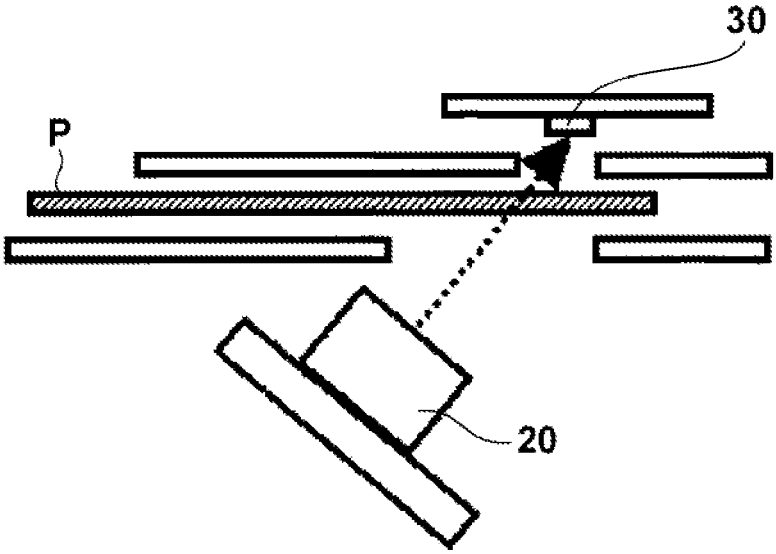
FIG. 8 is a view showing the schematic arrangement of a multi-feed detection apparatus when viewed from the side.

In the multi-feed detection apparatuses according to the first and second embodiments described above, the multi-feed detection configuration is constructed by arranging the transmitter above the conveyance path and arranging the receiver below the conveyance path. However the present invention is not limited to this, as a matter of course. For example, the arrangement of the ultrasonic transmitter and receiver may be reversed. That is, as shown in FIG. 8, the ultrasonic transmitter 20 may be arranged below the conveyance path 11 to originate an ultrasonic wave upward, and the facing receiver 30 may be arranged above the conveyance path 11. At this time, similar to the first and second embodiments described above, the ultrasonic reception surface of the receiver 30 is set to be almost parallel to the conveyance path 11. This can effectively avoid a situation in which multi-feed detection is hindered by a foreign substance such as paper dust generated by conveyance of a sheet member along the conveyance path 11. Especially when a MEMS element is used as the receiver 30, the receiver 30 (and the through hole in the conveyance path forming plate on the receiving side) can be relatively downsized, compared to the transmitter 20 (and the through hole in the conveyance path forming plate on the transmitting side). Considering the influence of attachment of a foreign substance such as paper dust to the ultrasonic reception surface, the receiver 30 is desirably arranged above the conveyance path 11 (for example, the upper side in the direction of gravity (upper side in the vertical direction in FIG. 8) with respect to the conveyance path 11), as shown in FIG. 8. This can contribute to downsizing of the multi-feed detection apparatus, and the multi-feed detection performance can be maintained more stably.

Figure 9:
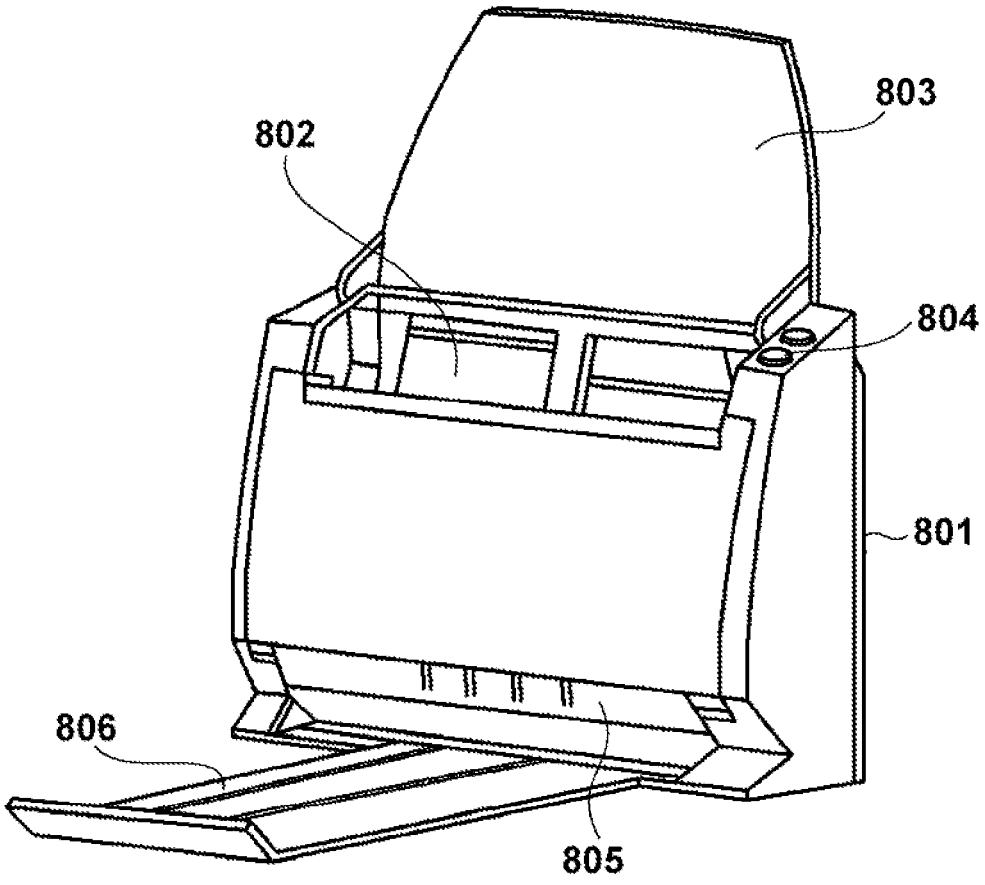
FIG. 9 is a view exemplifying the schematic arrangement of a sheet processing apparatus.

FIG. 9 is a view exemplifying another arrangement of a sheet-like member conveyance apparatus including the multi-feed detection apparatus according to the present invention.

In FIG. 9, reference numeral 801 denotes an image reading apparatus main body (to be referred to as a sheet-like member conveyance apparatus main body hereinafter) serving as a sheet-like member conveyance apparatus including the multi-feed detection apparatus 10 described in the first or second embodiment. Reference numeral 802 denotes a sheet feed port; 803, a sheet feed tray; 804, an operation unit; 805, a discharge port; and 806, a discharge tray.

When scan instruction information is input from the operation unit 804, sheet-like members (not shown) serving as objects stacked on the sheet feed tray 803 are conveyed one by one into the sheet-like member conveyance apparatus main body 801 via the sheet feed port 802. Image information of the sheet-like member conveyed inside the sheet-like member conveyance apparatus main body 801 is read by an image reading sensor (not shown). After that, the sheet-like member is conveyed in the discharge direction, and discharged from the sheet-like member conveyance apparatus main body 801 via the discharge port 805. Sheet-like members discharged from the sheet-like member conveyance apparatus main body 801 are sequentially stacked on the discharge tray 806.

Figure 10:
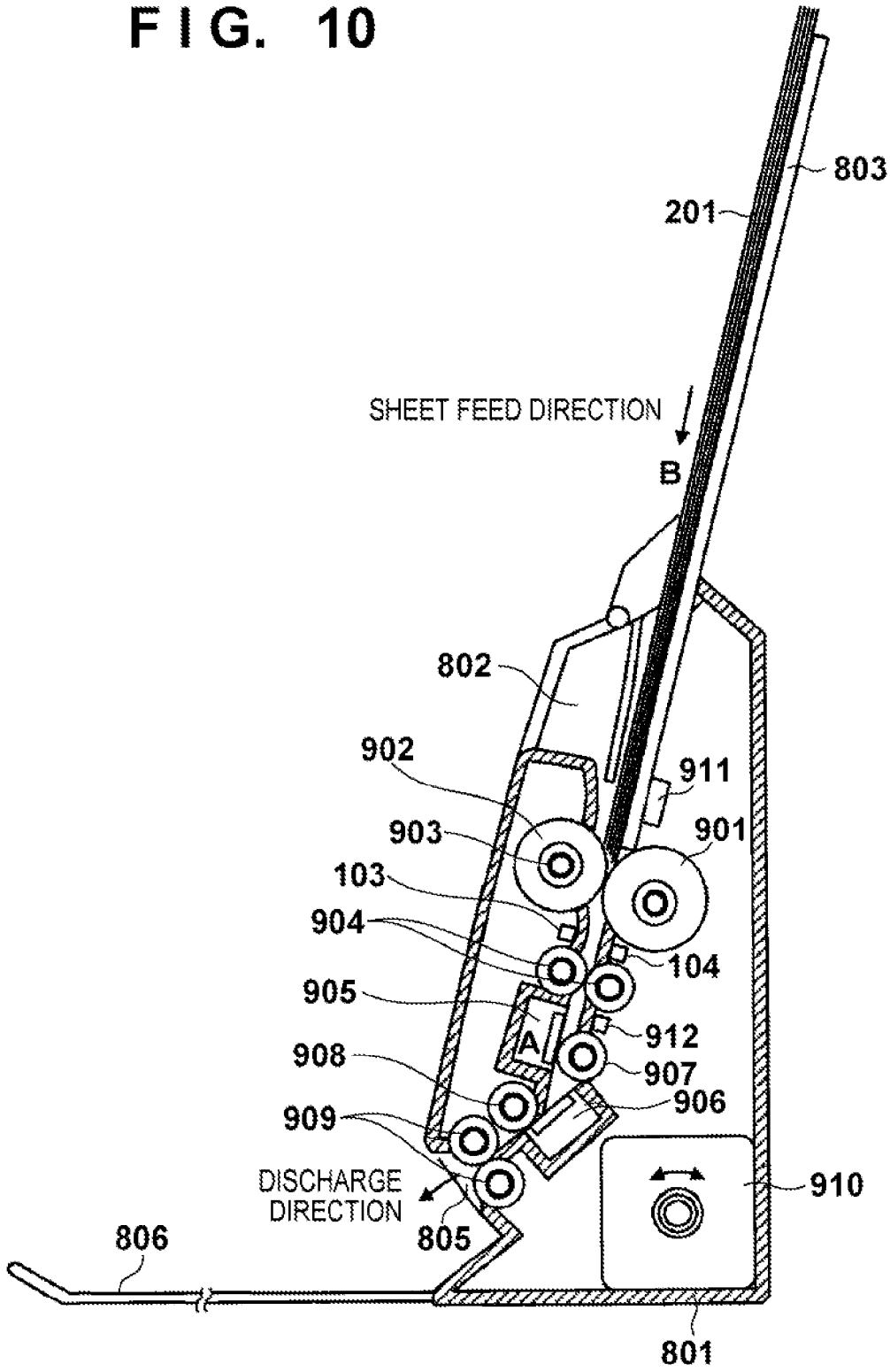
FIG. 10 is a view exemplifying the schematic arrangement of the sheet processing apparatus.

FIG. 10 is a sectional view showing the internal structure of the sheet-like member conveyance apparatus main body 801 shown in FIG. 9. In FIG. 10, the same reference numerals as those in FIG. 9 denote the same parts.

In FIG. 10, reference numeral 901 denotes a feed roller; and 902, a retard roller including a torque limiter 903 between the retard roller 902 and a rotating shaft. By the action of the feed roller 901 and retard roller 902, sheet-like members 201 stacked on the sheet feed tray 803 are separated one by one, and conveyed into the sheet-like member conveyance apparatus main body 801 via the sheet feed port 802 in a direction indicated by the arrow B in FIG. 10. Reference numerals 904 denote conveyance rollers which further convey, toward the discharge port 805, sheet-like members conveyed one by one by the action of the feed roller 901 and retard roller 902.

Reference numeral 905 denotes an image reading unit (reverse surface image reading unit) which reads the reverse surface of a sheet-like member. Reference numeral 906 denotes an image reading unit (obverse surface image reading unit) which reads the obverse surface of a sheet-like member. The image reading units 905 and 906 configure a double-sided image reading unit. Each of the reverse surface image reading unit 905 and obverse surface image reading unit 906 incorporates a light source (not shown) for irradiating a sheet-like member, and an image reading sensor (not shown) for reading image information of a sheet-like member. The double-sided image reading unit reads the image of a sheet-like member at a reading position A in FIG. 11. Reference numeral 907 denotes a first platen roller which presses a conveyed sheet-like member to bring it into tight contact with the reverse surface image reading unit 905 at the reading position A. Reference numeral 908 denotes a second platen roller which presses a conveyed sheet-like member to bring it into tight contact with the obverse surface image reading unit 906 at the reading position A.

Reference numerals 909 denote discharge rollers which discharge a conveyed sheet-like member from the sheet-like member conveyance apparatus main body 801 via the discharge port 805. Reference numeral 910 denotes a conveyance driving source which is a conveyance motor in general. The conveyance driving source 910 is connected to the rotating shaft of each roller described above by a gear mechanism or belt mechanism (neither is shown). When the conveyance driving source 910 rotates, each roller described above rotates to convey a sheet-like member in a predetermined direction at a predetermined speed. When the conveyance driving source 910 rotates clockwise in FIG. 11, the sheet-like member is conveyed from the sheet feed port 802 to the discharge port 805. Reference numeral 911 denotes an original detection sensor which detects whether there is a sheet-like member in the sheet feed port 802. Reference numeral 912 denotes a pre-feed detection sensor which detects the end of a conveyed sheet-like member.

An ultrasonic originating unit 103 and ultrasonic receiving unit 104 are arranged upstream side of the conveyance rollers 904 to detect the multi-feed state of fed sheet-like members. The ultrasonic originating unit 103 and ultrasonic receiving unit 104 are arranged to face each other via a sheet-like member conveyance path so that an ultrasonic wave originated by the ultrasonic originating unit 103 can pass through a sheet-like member serving as a multi-feed detection target and be received by the ultrasonic receiving unit 104. A multi-feed detection unit including the ultrasonic originating unit 103 and ultrasonic receiving unit 104 is applicable to the multi-feed detection apparatus according to the first or second embodiment described above.

Note that the ultrasonic originating unit 103 and ultrasonic receiving unit 104 may be arranged downstream of the conveyance rollers 904.

In addition to the above-described embodiments, the present invention is widely applied to an arrangement including at least one of the following arrangements in a multi-feed detection apparatus including an ultrasonic transmission unit, arranged on one side of a conveyance path configured to convey a sheet-like member, for transmitting an ultrasonic wave toward the conveyance path, an ultrasonic reception unit, arranged on the other side of the conveyance path, for receiving the ultrasonic wave from the ultrasonic transmission unit, and a multi-feed determination unit for determining, based on the reception result of the ultrasonic wave received by the ultrasonic reception unit, whether multi-feed of sheet-like members has occurred:

(1) a structure in which the ultrasonic reception unit is arranged to have an outer shape smaller than that of the ultrasonic transmission unit.

(2) a structure in which the ultrasonic reception surface of the ultrasonic reception unit is smaller than the ultrasonic transmission surface of the ultrasonic transmission unit.

(3) a structure in which the ultrasonic reception surface of the ultrasonic reception unit is smaller than the ultrasonic transmission surface of the ultrasonic transmission unit and is positioned in a region where the ultrasonic reception surface faces the ultrasonic transmission surface.

(4) a structure in which the multi-feed detection apparatus includes a conveyance path forming plate configured to separate the ultrasonic transmission unit from the conveyance path and form at least part of the conveyance path, a through hole is formed at a portion of the conveyance path forming plate that faces the ultrasonic transmission unit, and the opening of the through hole is smaller than the ultrasonic transmission surface of the ultrasonic transmission unit.

In the multi-feed detection apparatus having at least one of structures (1) to (4), the ultrasonic reception unit becomes relatively smaller than the ultrasonic transmission unit. The apparatus can be downsized, the degree of freedom of the design can be increased, and the cost of the apparatus can be reduced.

Although the structure of the sheet-like member conveyance apparatus including the multi-feed detection apparatus according to the present invention has been exemplified, the multi-feed detection apparatus according to the present invention is applicable to another form as long as the apparatus conveys a sheet-like member. For example, the multi-feed detection apparatus according to the present invention can be similarly arranged in a scanner, printer, copying machine, facsimile machine, printing machine, ATM (Automated Teller Machine), and the like.

The present invention is not limited to the above-described embodiments, and various modifications (including organic combinations of the embodiments) can be made based on the gist of the present invention and are not excluded from the scope of the present invention. Note that the present invention includes all arrangements as combinations of the above-describe embodiments and their modifications.

What is claimed is:

1. A multi-feed detection apparatus comprising:

an ultrasonic transmission unit, arranged on one side of a conveyance path configured to convey a sheet-like member, for transmitting an ultrasonic wave toward the conveyance path;

an ultrasonic reception unit, arranged on the other side of the conveyance path, for receiving the ultrasonic wave from said ultrasonic transmission unit; and a multi-feed determination unit for determining, based on a reception result of the ultrasonic wave received by said ultrasonic reception unit, whether multi-feed of sheet-like members has occurred, wherein an ultrasonic transmission surface of said ultrasonic transmission unit is inclined with respect to the conveyance path, and an ultrasonic reception surface of said ultrasonic reception unit is arranged to be substantially parallel to the conveyance path.

2. The multi-feed detection apparatus according to claim 1, wherein said ultrasonic transmission unit includes a plurality of ultrasonic transmission units arranged for said ultrasonic reception unit.

3. The multi-feed detection apparatus according to claim 2, wherein the ultrasonic transmission surface of one of the plurality of ultrasonic transmission units has a larger inclination angle with respect to the conveyance path, compared to the ultrasonic transmission surfaces of another one of the plurality of ultrasonic transmission units.

4. The multi-feed detection apparatus according to claim 2, wherein the plurality of ultrasonic transmission units have different ultrasonic transmission frequencies, and an ultrasonic transmission surface of one of the plurality of ultrasonic transmission units having a first ultrasonic transmission frequency has a larger inclination angle with respect to the conveyance path, compared to an ultrasonic transmission surface of another one of the plurality of ultrasonic transmission units having a second ultrasonic transmission frequency, and the first ultrasonic transmission frequency is higher than the second ultrasonic transmission frequency.

5. The multi-feed detection apparatus according to claim 2, wherein each of the plurality of ultrasonic transmission units is arranged at different ultrasonic transmission angles with respect to said ultrasonic reception unit when viewed from a direction perpendicular to the ultrasonic reception surface of said ultrasonic reception unit.

6. The multi-feed detection apparatus according to claim 5, wherein each of the plurality of ultrasonic transmission units is arranged with a positional relationship in which respective ultrasonic transmission directions to said ultrasonic reception unit become perpendicular to each other.

7. The multi-feed detection apparatus according to claim 1, wherein said ultrasonic transmission unit and said ultrasonic reception unit have different inclination angles with respect to the conveyance path.

8. The multi-feed detection apparatus according to claim 1, wherein said ultrasonic reception unit is arranged to have an outer shape smaller than an outer shape of said ultrasonic transmission unit.

9. The multi-feed detection apparatus according to claim 1, wherein the ultrasonic reception surface of said ultrasonic reception unit is smaller than the ultrasonic transmission surface of said ultrasonic transmission unit.

10. The multi-feed detection apparatus according to claim 1, wherein the ultrasonic reception surface of said ultrasonic reception unit is smaller than the ultrasonic transmission surface of said ultrasonic transmission unit and is positioned in a region where the ultrasonic reception surface faces the ultrasonic transmission surface.

11. The multi-feed detection apparatus according to claim 1, wherein the multi-feed detection apparatus includes a conveyance path forming plate configured to separate said ultrasonic transmission unit from the conveyance path and form at least part of the conveyance path, a through hole is formed at a portion of the conveyance path forming plate that faces said ultrasonic transmission unit, and an opening of the through hole is smaller than the ultrasonic transmission surface of said ultrasonic transmission unit.

12. The multi-feed detection apparatus according to claim 1, wherein said ultrasonic reception unit includes a MEMS element which includes an ultrasonic receiving unit having the ultrasonic reception surface and a holding portion configured to hold the ultrasonic receiving unit, and is formed on a substrate.

13. The multi-feed detection apparatus according to claim 1, wherein said ultrasonic transmission unit is arranged below the conveyance path, and said ultrasonic reception unit is arranged above the conveyance path to face said ultrasonic transmission unit.

14. The multi-feed detection apparatus according to claim 1, wherein said ultrasonic reception unit is connected to signal amplification unit for amplifying a received reception signal, and said multi-feed determination unit determines, based on a signal waveform output from the signal amplification unit, whether multi-feed of sheet members has occurred.

15. The multi-feed detection apparatus according to claim 14, wherein said ultrasonic transmission unit includes a plurality of ultrasonic transmission unit having different ultrasonic transmission frequencies, and the signal amplification unit changes an amplification condition of the reception signal based on a frequency transmitted from at least one ultrasonic transmission unit among said plurality of ultrasonic transmission unit.

16. The multi-feed detection apparatus according to claim 1, wherein said ultrasonic transmission unit includes a plurality of ultrasonic transmission units having different ultrasonic transmission frequencies, and the multi-feed detection apparatus further comprises selection unit for selecting, from said plurality of ultrasonic generation units, at least one ultrasonic generation unit for transmitting an ultrasonic wave.

17. A sheet conveyance apparatus comprising:

a multi-feed detection apparatus arranged in a conveyance apparatus main body configured to convey a sheet-like member along a conveyance path, wherein said multi-feed detection apparatus comprises:

an ultrasonic transmission unit, arranged on one side of a conveyance path configured to convey a sheet-like member, for transmitting an ultrasonic wave toward the conveyance path;

an ultrasonic reception unit, arranged on the other side of the conveyance path, for receiving the ultrasonic wave from said ultrasonic transmission unit; and a multi-feed determination unit for determining, based on a reception result of the ultrasonic wave received by said ultrasonic reception unit, whether multi-feed of sheet-like members has occurred, wherein an ultrasonic transmission surface of said ultrasonic transmission unit is inclined with respect to the conveyance path, and an ultrasonic reception surface of said ultrasonic reception unit is arranged to be substantially parallel to the conveyance path.

18. A sheet processing apparatus comprising:

a sheet conveyance apparatus; and a sheet processing unit configured to perform predetermined processing for a sheet-like member conveyed by said sheet conveyance apparatus, wherein said sheet conveyance apparatus comprising:

a multi-feed detection apparatus arranged in a conveyance apparatus main body configured to convey a sheet-like member along a conveyance path, wherein said multi-feed detection apparatus comprises:

an ultrasonic transmission unit, arranged on one side of a conveyance path configured to convey a sheet-like member, for transmitting an ultrasonic wave toward the conveyance path;

an ultrasonic reception unit, arranged on the other side of the conveyance path, for receiving the ultrasonic wave from said ultrasonic transmission unit; and a multi-feed determination unit for determining, based on a reception result of the ultrasonic wave received by said ultrasonic reception unit, whether multi-feed of sheet-like members has occurred, wherein an ultrasonic transmission surface of said ultrasonic transmission unit is inclined with respect to the conveyance path, and an ultrasonic reception surface of said ultrasonic reception unit is arranged to be substantially parallel to the conveyance path.

* * * * *